US005727985A

United States Patent [19]

George et al.

[11] Patent Number: 5,727,985

[45] Date of Patent: Mar. 17, 1998

[54] STUNT PERFORMING TOY VEHICLE

[75] Inventors: Kevin M. George, Cincinnati; Michele P. Trammell, Williamsburg, both of Ohio

[73] Assignee: Tonka Corporation, Pawtucket, R.I.

[21] Appl. No.: 610,569

[22] Filed: Mar. 8, 1996

Related U.S. Application Data

[63] Continuation of Ser. No. 430,097, Apr. 26, 1995, abandoned, which is a continuation of Ser. No. 248,265, May 24, 1994, abandoned.

[51] Int. Cl.[6] ..... A63H 30/04

[52] U.S. Cl. ..... 446/437; 446/456; 446/465; 446/470

[58] Field of Search ..... 446/431, 437, 446/439, 454, 456, 465, 486, 433, 441, 442, 470

[56] References Cited

U.S. PATENT DOCUMENTS

| | | | |
|---|---|---|---|
| D. 262,224 | 12/1981 | Aoki | D21/128 |
| D. 294,278 | 2/1988 | Ukisu | D21/128 |
| D. 313,823 | 1/1991 | Scheckel | D21/128 |
| D. 336,935 | 6/1993 | York et al. | D21/124 |
| 1,623,144 | 4/1927 | Weiss | 446/484 |
| 1,828,288 | 10/1931 | Marx | 446/433 |
| 1,868,313 | 7/1932 | Daubendiek | 446/457 |
| 2,064,309 | 12/1936 | Lohr . | |
| 2,247,354 | 7/1941 | Berer | 446/437 |
| 2,383,441 | 8/1945 | Beile . | |
| 3,263,363 | 8/1966 | Doe . | |
| 3,445,959 | 5/1969 | Barlow et al. | 446/442 |
| 3,646,706 | 3/1972 | Adickes . | |
| 3,733,739 | 5/1973 | Terzian . | |
| 3,785,085 | 1/1974 | Peroni | 446/437 |
| 3,816,958 | 6/1974 | Winston . | |
| 4,107,872 | 8/1978 | Tucker et al. . | |
| 4,112,615 | 9/1978 | Ishimoto | 446/456 |
| 4,168,468 | 9/1979 | Mabuchi et al. . | |
| 4,197,672 | 4/1980 | Mabuchi et al. . | |
| 4,209,942 | 7/1980 | Lohr | 446/454 |
| 4,213,270 | 7/1980 | Oda | 446/456 |
| 4,300,308 | 11/1981 | Ikeda . | |
| 4,385,466 | 5/1983 | ReVelle . | |
| 4,406,085 | 9/1983 | Rhodes . | |
| 4,411,639 | 10/1983 | Rüther | 446/470 |
| 4,471,567 | 9/1984 | Martin | 446/456 |
| 4,490,124 | 12/1984 | Ogawa | 446/464 |
| 4,508,516 | 4/1985 | D'Andrade et al. | 446/454 |
| 4,674,585 | 6/1987 | Barlow et al. | 446/462 |
| 4,690,656 | 9/1987 | Friedman et al. | 446/424 |
| 4,773,889 | 9/1988 | Rosenwinkel et al. | 446/465 |
| 4,832,651 | 5/1989 | Buck | 446/465 |
| 4,969,851 | 11/1990 | Rasmussen | 446/441 |
| 5,090,934 | 2/1992 | Quercetti | 446/471 |
| 5,173,073 | 12/1992 | Franzone | 446/465 |
| 5,228,880 | 7/1993 | Meyer et al. | 446/465 |

FOREIGN PATENT DOCUMENTS

| | | | |
|---|---|---|---|
| 2182859 | 5/1987 | United Kingdom | 446/471 |
| 2184364 | 6/1987 | United Kingdom | 446/437 |

OTHER PUBLICATIONS

Echo Pro "Wild Stunter", Echo Toys LTD ©1993.

*Primary Examiner*—Michael A. Brown
*Assistant Examiner*—Jeffrey D. Carlson
*Attorney, Agent, or Firm*—Marshall, O'Toole, Gerstein, Murray & Borun

[57] ABSTRACT

A remote control toy vehicle includes an invertible chassis having vehicle body portions on opposite sides thereof, a plurality of highly resilient balloon tire support wheels, a high torque drive motor assembly for driving at least one of the support wheels and a remote control receiver circuit. The chassis and the support wheels are constructed and positioned so that the support wheels define a three dimensional maximum outer perimeter of the vehicle from which the chassis and the other components of the vehicle are spaced inwardly, and the remote control receiver circuit includes an antenna which is contained within the body of the vehicle. The high torque drive motor assembly, the position of the antenna, and the positions and configurations of the support wheels enable the vehicle to perform a variety of self-inverting, tumbling and deflecting maneuvers.

2 Claims, 11 Drawing Sheets

STUNT PERFORMING TOY VEHICLE

This is a continuation of U.S. application Ser. No. 08/430,097, filed Apr. 26, 1995, now abandoned, which was a continuation of U.S. application Ser. No. 08/248,265, filed May 24, 1994, now abandoned.

BACKGROUND AND SUMMARY OF THE INVENTION

The instant invention relates to toy vehicles and more particularly to a remote control toy vehicle which is capable of performing a wide variety of stunts and maneuvers.

It has been found that remote control vehicles generally have relatively high levels of play value. Further, it has been found that remote control toy vehicles which are capable of performing various stunts or maneuvers frequently have increased levels of play value. As a result, a number of remote control toy vehicles have been heretofore available which have been adapted for performing various stunts, such as turning maneuvers and the like. In general, however, the heretofore available remote control toy vehicles have not been adapted for performing self-inverting and/or tumbling maneuvers or for operating in inverted dispositions.

The instant invention provides a new and innovative toy vehicle which is adapted for performing dynamic and exciting maneuvers which have not been possible with the heretofore available toy vehicles. More specifically, the instant invention provides a toy vehicle which is adapted for high speed operation and which is capable of performing a variety of self-inverting and tumbling maneuvers, as well as for operating in an inverted disposition. Still more specifically, the toy vehicle of the instant invention comprises a chassis, a plurality of resilient support wheels mounted on the chassis for movably supporting the chassis on a supporting surface, and a drive assembly on the chassis for driving at least one of the support wheels in order to propel the vehicle on the supporting surface. The support wheels are mounted on the chassis for rotation about axes which are substantially unsprung and preferably immovable relative to the chassis, and accordingly, physical shocks delivered to the chassis are normally cushioned entirely by the support wheels. Further, the support wheels, the chassis, and the drive assembly are dimensioned and constructed so that the support wheels define a three-dimensional perimeter of the vehicle which is spaced outwardly from the other components of the vehicle. Still further, the support wheels are sufficiently resilient so that when the vehicle is dropped from an initial elevation of approximately six inches onto a rigid supporting surface, such as a concrete surface, the average rebound height of the support wheels is at least approximately thirty percent of the initial elevation of the support wheels. The vehicle preferably comprises four support wheels and two drive motors for driving two of the four support wheels. Further, the support wheels preferably each comprise a center hub portion and a pneumatic balloon tire portion of toroidal configuration. The drive motors are preferably reversible and independently controllable for driving two of the support wheels. The drive motors preferably comprise high torque drive motors which have sufficient torque to pivot the non-driven end of the vehicle upwardly when the wheels on the non-driven end are in engagement with a vertical abutment surface and the chassis is in an upwardly inclined angle of approximately twenty degrees relative to horizontal. The support wheels are preferably all of substantially the same diameter and the drive assembly preferably includes a battery power supply, and both of the drive motors and the battery power supply are preferably positioned between the front and rear axles with the weights thereof substantially uniformly distributed on opposite sides of the central plane of the vehicle chassis. Still further, the chassis preferably includes first and second vehicle upper body portions on opposite sides thereof so that when the vehicle is in a first position on a supporting surface, one of the body portions faces upwardly, and when the vehicle is in an inverted second position, the other body portion faces upwardly.

The remote control toy vehicle preferably further comprises a remote control receiver and an antenna. The receiver is preferably mounted within the body portion of the chassis, and the antenna is preferably positioned, constructed and dimensioned so that it is contained entirely within the three-dimensional outer perimeter of the vehicle. Further, the antenna is preferably contained within the interior of the body portion of the vehicle so that it is not only concealed during use, but so that it is also protected against damage when the vehicle is performing various stunts or maneuvers.

It has been found that the remote control toy vehicle of the instant invention is capable of performing a wide variety of stunts and maneuvers which were not possible with the heretofore available remote control toy vehicles. Specifically, because the support wheels of the vehicle define an outwardly spaced three-dimensional perimeter, whenever the vehicle contacts a flat surface, such as a wall or a floor surface, the surface is contacted by one or more of the support wheels rather than by other portions of the vehicle. Further, because of the resiliency of the support wheels, the vehicle is capable of bouncing or tumbling on a supporting surface so that only the support wheels contact the surface. Still further, because the support wheels are mounted on the chassis about substantially unsprung axes, shocks which are transmitted to the vehicle through the support wheels are cushioned solely by the support wheels. This enables the vehicle to perform various maneuvers, including tumbling maneuvers, more efficiently by causing it to bounce from wheel to wheel once a tumbling maneuver has been initiated. Still further, because the vehicle is operative with a pair of high torque motors, and because it has upper vehicle bodies on opposite sides thereof, it is capable of performing various self-inverting maneuvers and it appears as a fully operative vehicle, regardless of whether or not it is in an inverted disposition. Even still further, because the antenna of the remote control receiver is contained within the vehicle body, the antenna is protected against damage which would likely result if it were unprotected or if it extended beyond the three-dimensional perimeter of the vehicle.

Accordingly, it is a primary object of the instant invention to provide a remote control toy vehicle which is capable of performing a variety of unique and dynamic stunts.

Another object of the instant invention is to provide a remote control toy vehicle having resilient tires and constructed so that when it contacts a substantially flat surface, only the tires on the vehicle contact the surface regardless of the disposition of the vehicle.

An even still further object of the instant invention is to provide a toy vehicle which is capable of performing self-inverting maneuvers.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
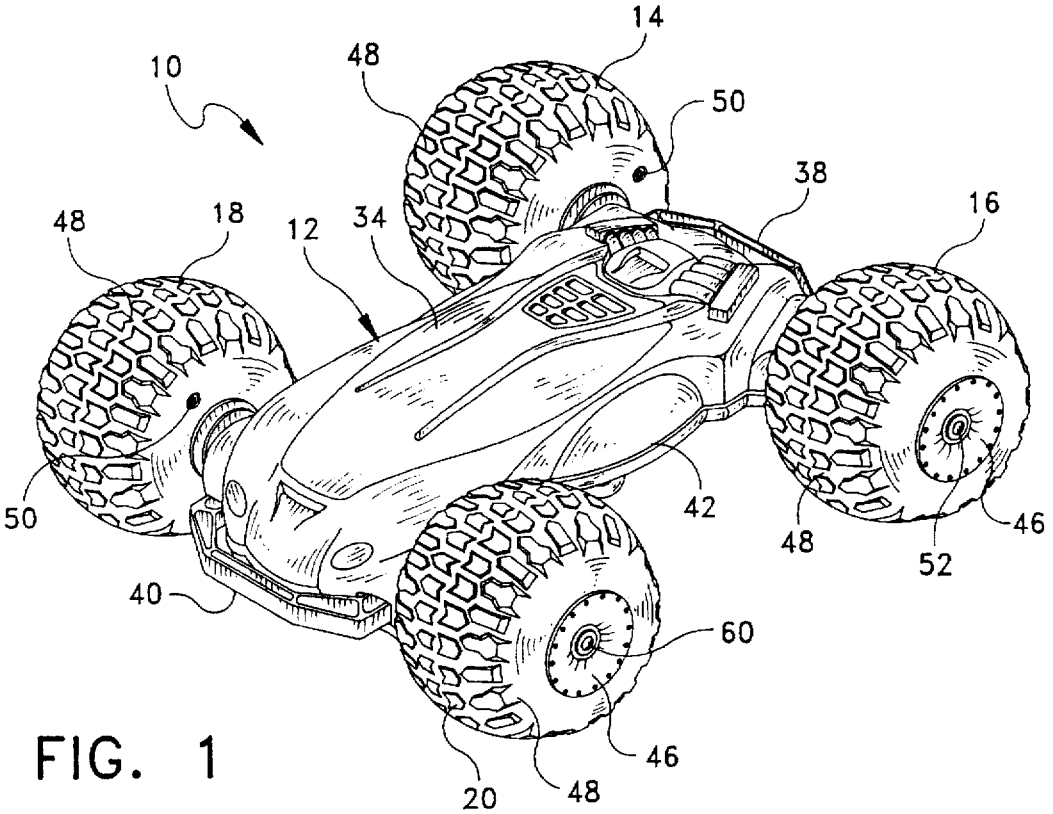
FIG. 1 is a perspective view of the remote control toy vehicle of the instant invention in a first position.
Figure 2:
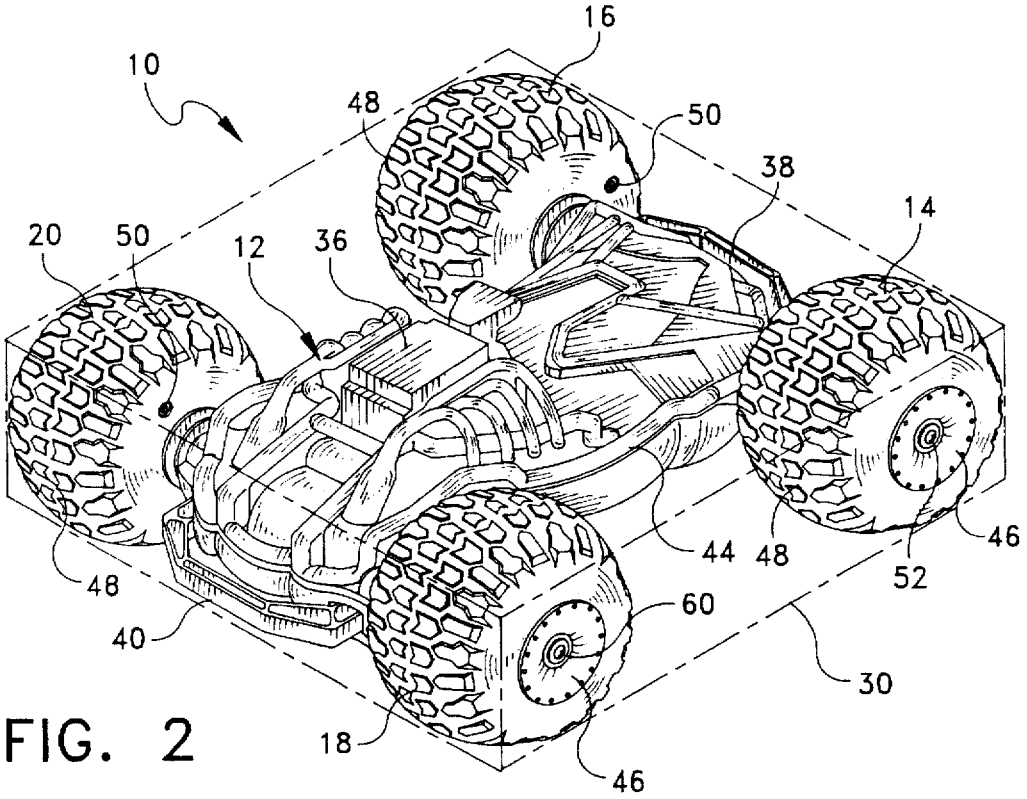
FIG. 2 is a similar perspective view thereof in an inverted second position.
Figure 3:
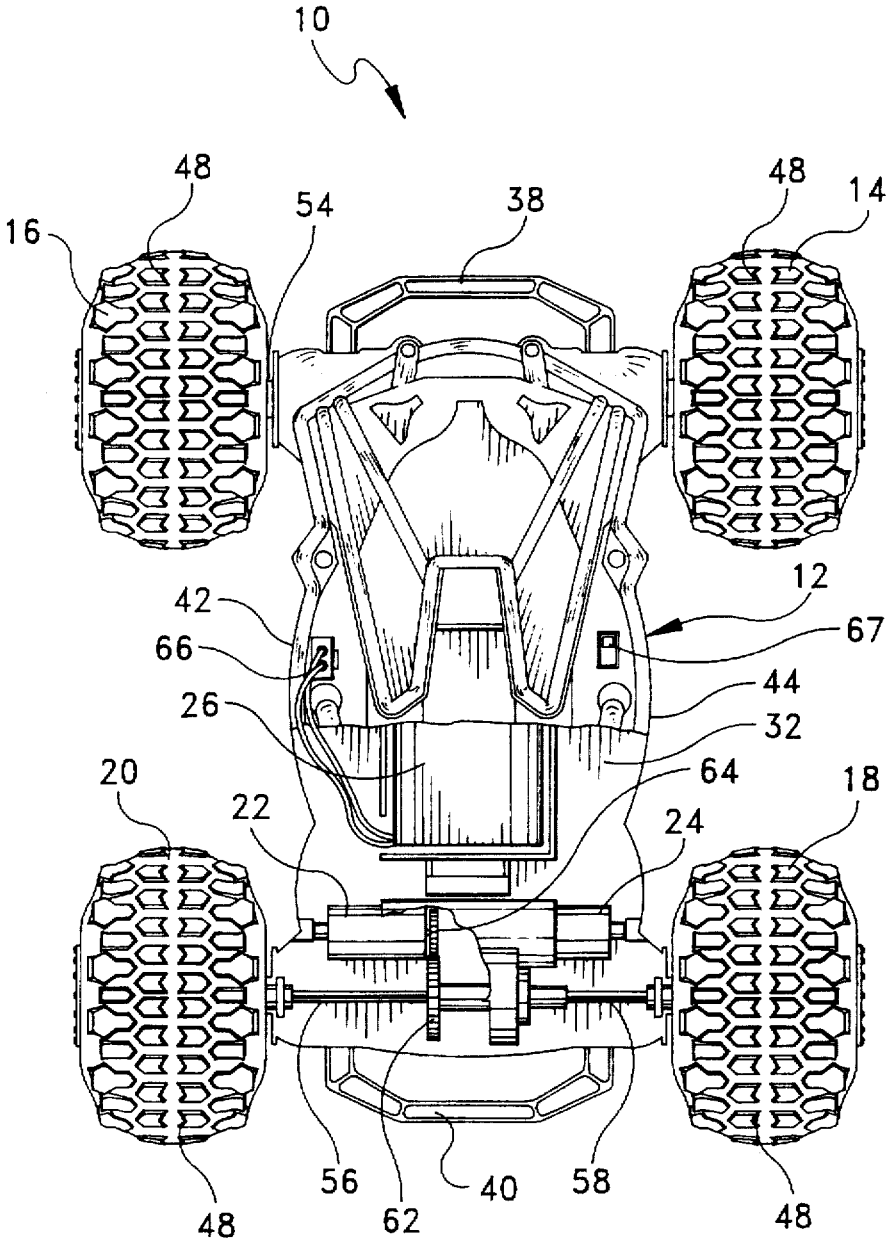
FIG. 3 is a top plan view thereof in the inverted second position with portions of the vehicle body broken away.
Figure 4:
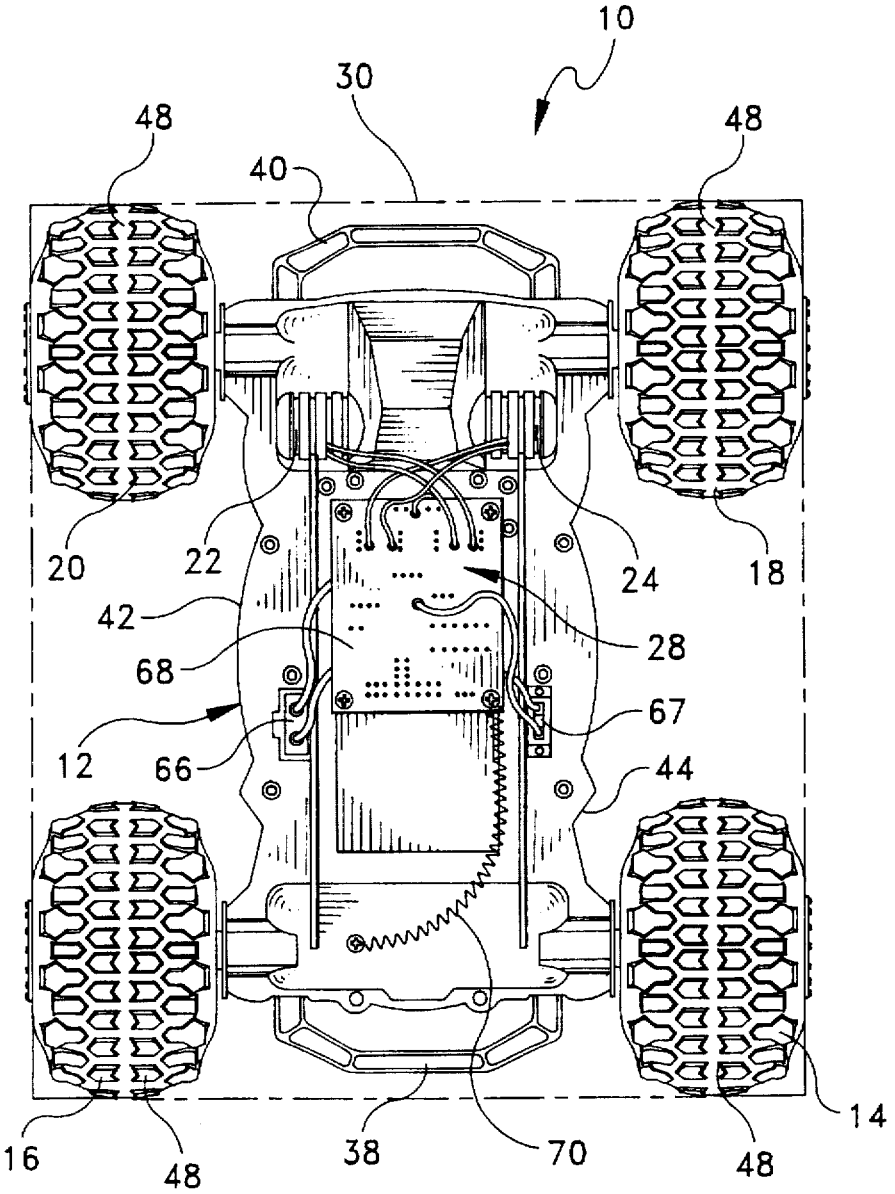
FIG. 4 is a top plan view thereof in the first position with the upper body portion removed.
Figure 5:
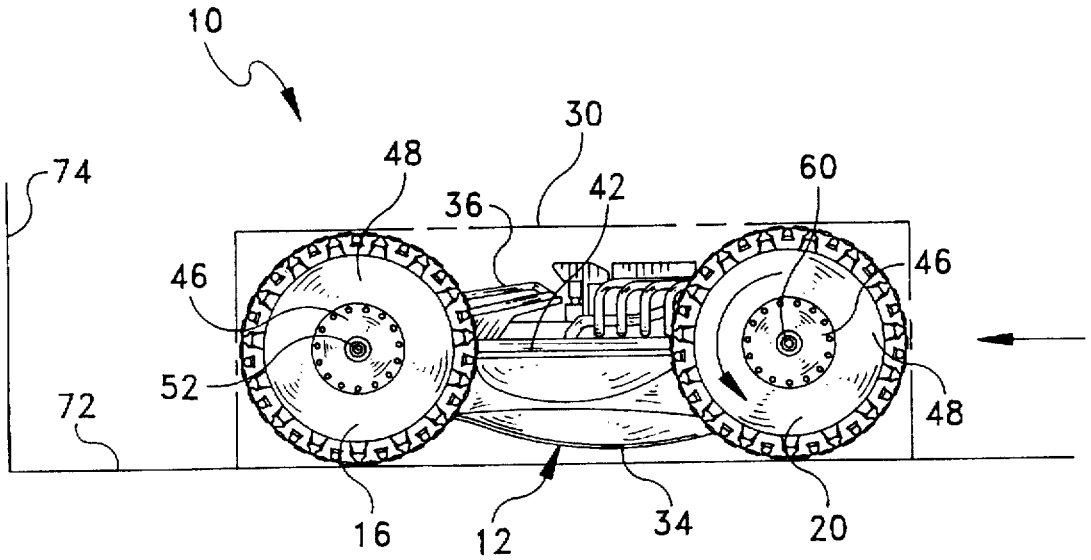
FIGS. 5 through 11 are sequential side elevational views of the vehicle during a self-inverting maneuver.
Figure 6:
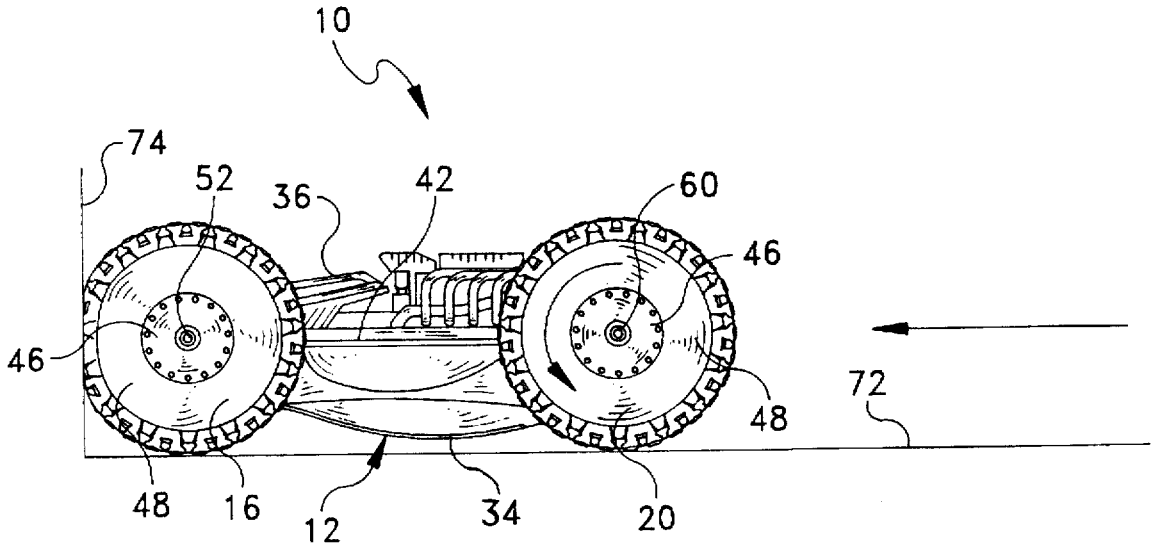

Referring now to the drawings, the remote control toy vehicle of the instant invention is illustrated in FIGS. 1 through 21 and generally indicated at 10. The toy vehicle 10 comprises a chassis generally indicated at 12, first and second free-spinning balloon tire support wheels 14 and 16, respectively, first and second balloon tire drive support wheels 18 and 20, respectively, and first and second drive motors 22 and 24, respectively, for driving the support wheels 18 and 20, respectively. The vehicle 10 further comprises a battery power supply 26, illustrated in FIGS. 3 and 4, and a remote control receiver assembly generally indicated at 28 in FIG. 4. The vehicle 10 is constructed so that the support wheels 14, 16, 18 and 20 define a maximum three-dimensional perimeter 30 which is spaced outwardly from the other components of the vehicle 10 as illustrated in FIGS. 2, 4 and 5. Accordingly, the vehicle 10 is operative so that when it engages a substantially flat surface, regardless of whether the surface is horizontal, vertical, or angularly disposed, the surface is always contacted by one or more of the balloon tire support wheels 14, 16, 18 or 20, rather than other parts of the vehicle 10, such as the chassis 12. As a result, when the vehicle 10 impacts a substantially flat surface, one or more of the support wheels 14, 16, 18 or 20 contact the surface and cause the vehicle 10 to bounce back from the surface with a high level of resiliency, which, under appropriate circumstances, can cause the vehicle 10 to flip over, tumble end-over-end, or roll side-over-side until the vehicle 10 again lands on all four of the support wheels 14, 16, 18 and 20 so that it can again be propelled by the motors 22 and 24.

The chassis 12 comprises a main frame portion 32 on which the battery 26, the motors 22 and 24, and the remote control circuit assembly 28 are mounted. The chassis 12 further includes a first upper body portion 34 which defines the outer configuration of a first side of the chassis 12, as illustrated in upwardly facing relation in FIG. 1. The chassis 12 also includes a second upper body portion 36 which defines the outer configuration of a second side of the chassis 12, which is illustrated in upwardly facing relation in FIG. 2. Accordingly, the vehicle 10 is adapted so that the chassis 12 thereof has the appearance of an upwardly facing vehicle body regardless of whether the vehicle 10 is in the first position illustrated in FIG. 1, or in the inverted second position illustrated in FIG. 2. The chassis 12 further includes first and second bumpers 38 and 40 which define first and second opposite or spaced longitudinal ends of the chassis 12; and the chassis 12 still further includes first and second spaced lateral extremities 42 and 44, respectively, which are defined by the main portion 32 of the chassis 12. In any event, as illustrated most clearly in FIGS. 2, 4 and 5, the spaced opposite sides or faces of the chassis, as defined by the body portions 34 and 36, the opposite ends of the chassis, as defined by the bumpers 38 and 40, and the opposite lateral extremities 42 and 44 are all spaced inwardly from the maximum three-dimensional outer perimeter 30 defined by the support wheels 14, 16, 18 and 20.

The first and second free-spinning balloon tire support wheels 14 and 16 are preferably of substantially the same diameter and formed in balloon tire configurations. Each of the support wheels 14 and 16 includes a hub portion 46 and an elastomeric pneumatic balloon tire portion 48 of generally toroidal configuration, and each of the balloon tire portions 48 includes a self-sealing inflation port 50 for inflating the tire portion 48 thereof with an appropriate level of air pressure to achieve the desired level of resiliency as will hereinafter be more fully set forth. The free-spinning first and second balloon tire support wheels 14 and 16 are coaxially mounted for rotation about an axis 52 which is fixed relative to the chassis 12, and, more specifically, the support wheels 14 and 16 are mounted on axles 54 which are rigidly attached to the chassis 12 so that the support wheels 14 and 16 are mounted in substantially unsprung relation on the chassis 12. As a result, physical shocks which are delivered to the chassis 12 through the inherently resilient support wheels 14 and 16 are cushioned substantially entirely by the support wheels 14 and 16. The balloon tire drive support wheels 18 and 20 are mounted on axles 56 and 58, respectively, for rotating about a common axis 60 which is also fixed relative to the chassis 12. The wheels 18 and 20 also include hub portions 46 and resilient pneumatic balloon tire portions 48, and the support wheels 18 and 20 are mounted on their respective axles 56 and 58, which in turn are directly mounted on the chassis 12 for rotation with the drive motor assemblies 22 and 24. The drive wheels 18 and 20 are also mounted on the chassis 12 in substantially unsprung relation so that shocks delivered to the chassis 12 through the drive wheels 18 and 20 are also cushioned substantially entirely by the drive wheels 18 and 20.

The drive motors 22 and 24 are of conventional construction, and they preferably comprise high torque, high speed drive motors which are operative for driving the axles 56 and 58 through gears 62 and 64 at relatively high speeds. The drive motors 22 and 24 are powered by the battery pack 26, which preferably comprises a conventional 9.6-volt battery pack, which is electrically connected to a plug 66 for supplying power to the motors 22 and 24 and the remote control receiver assembly 28 through an "on-off" switch 67.

The remote control receiver assembly 28 comprises a printed circuit board 68 and an antenna 70. The printed circuit board 68 is of conventional construction, and it is operative for receiving radio signals in order to independently and reversibly control the operation of the drive motors 22 and 24. The antenna 70 comprises a coil spring which is electrically connected to the printed circuit board 68, and it has an overall wire length which is appropriate for receiving radio signals for controlling the operation of the motors 22 and 24 through the circuit board 68.

As illustrated in FIGS. 2, 4 and 5, the maximum outer perimeter 30 of the vehicle 10 is defined by the resilient support wheels 14, 16, 18 and 20. More specifically, the three-dimensional perimeter 30, as referred to herein, comprises a three-dimensional rectangular shape consisting of horizontal and vertical planes which contact the longitudinally opposite, transversely opposite, and top and bottom extremities of the four wheels 14, 16, 18 and 20. In other words, the maximum outer perimeter is represented by the minimum size three-dimensional rectangular block-shaped structure which can accommodate the vehicle 10. In any event, because the maximum outer perimeter 30 is defined by the wheels 14, 16, 18 and 20, one or more of the wheels 14, 16, 18 and 20 will always make initial contact with a planar surface when the vehicle 10 is brought into engagement with the surface. Consequently, if the vehicle 10 is dropped from an elevated height onto a horizontal surface, one or more of the w contact with the horizontal surface to cushion the impact of the vehicle 10 therewith. Similarly, if the vehicle 10 is brought into engagement with a vertical wall or abutment, one or more of the wheels 14, 16, 18 or 20 make initial contact with the wall to cushion the impact of the vehicle 10 therewith.

In addition to the overall configuration of the vehicle 10, wherein the maximum outer perimeter 30 is deformed by the wheels 14, 16, 18 and 20, the resiliency of the wheels 14, 16, 18 and 20 has a significant effect on the overall operational characteristics of the vehicle 10. Specifically, because the wheels 14, 16, 18 and 20 are highly resilient and preferably comprise toroidally-shaped pneumatic balloon tires, the wheels 14, 16, 18 and 20 have particularly high resilient bounce characteristics. Specifically, it has been found that the wheels 14, 16, 18 and 20 are preferably constructed so that when the vehicle 10 is dropped from an elevation of approximately six inches onto a rigid supporting surface, such as a concrete supporting surface, the wheels 14, 16, 18 and 20 have an average rebound height of at least approximately thirty percent of their initial elevation, or at least approximately 1.8 inches. In fact, the wheels 14, 16, 18 and 20 preferably have an average rebound height of at least approximately forty percent of their original elevation, and in actual practice, wheels having average rebound heights of between sixty and seventy percent of their original elevations have been found to have optimal performance characteristics. In this regard, in a series of tests, vehicles weighing between approximately 3.28 and 3.32 pounds, and having tires 48 which had been inflated for optimum performance were dropped onto a substantially rigid test surface from an initial elevation of approximately six inches. The vehicle wheels were found to have average rebound heights of between approximately sixty percent and seventy percent.

Figure 7:
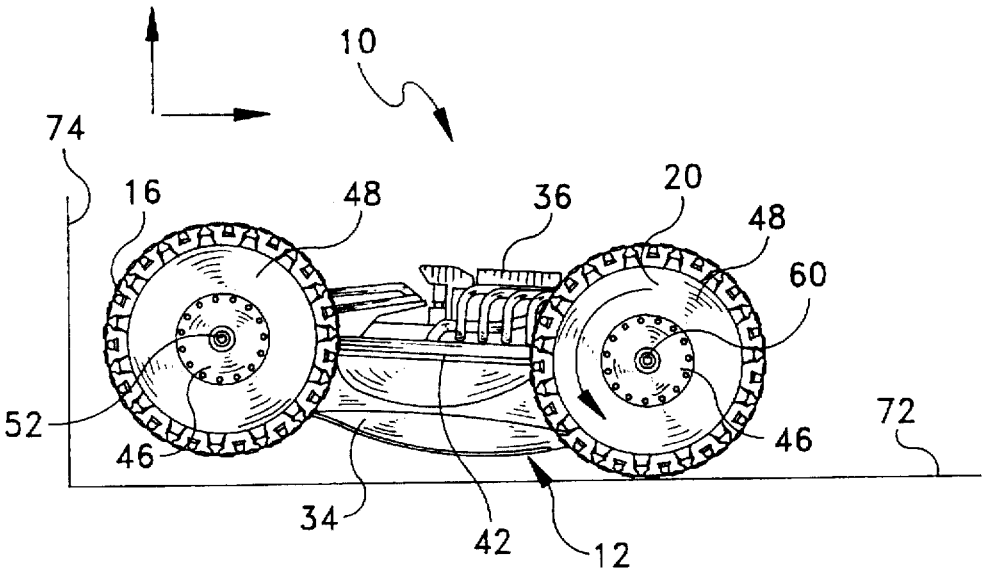
Figure 8:
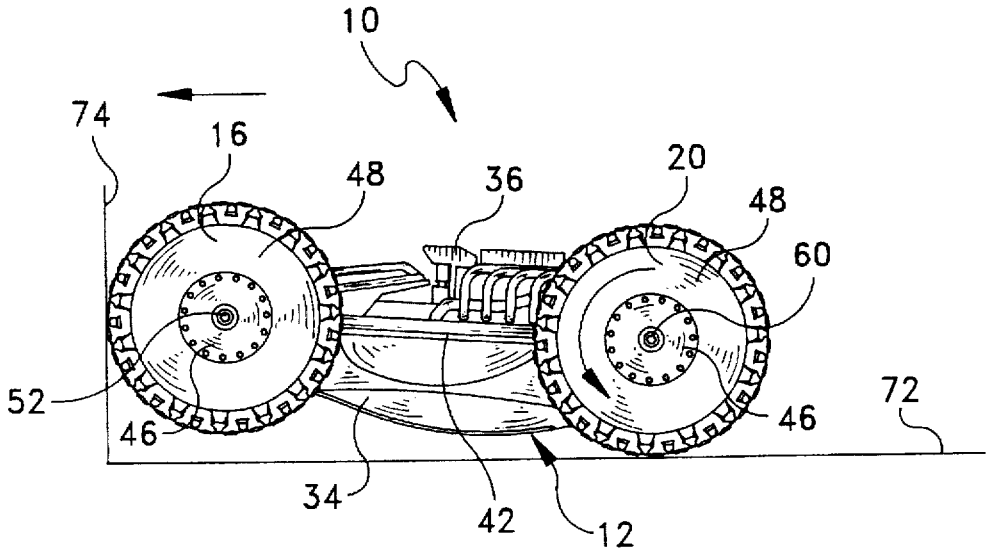
Figure 9:
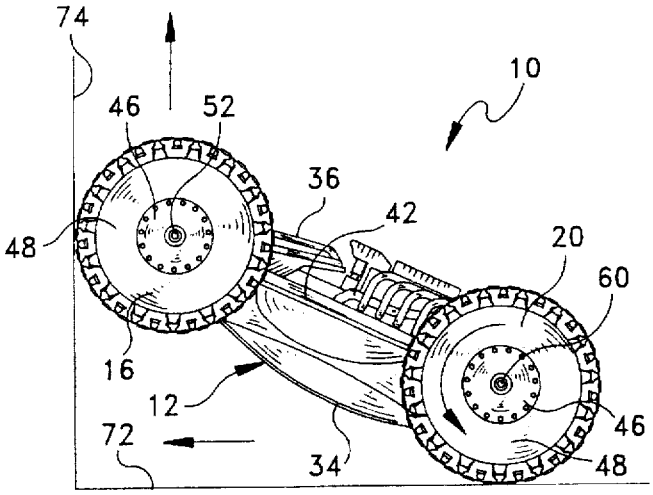
Figure 10:
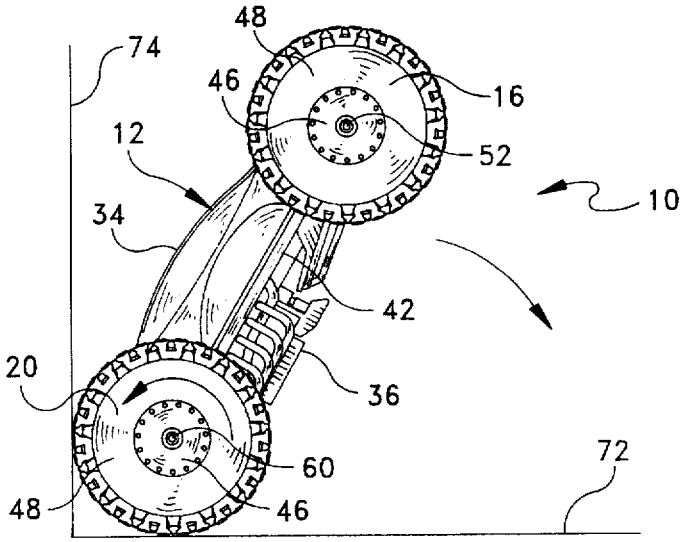
Figure 11:
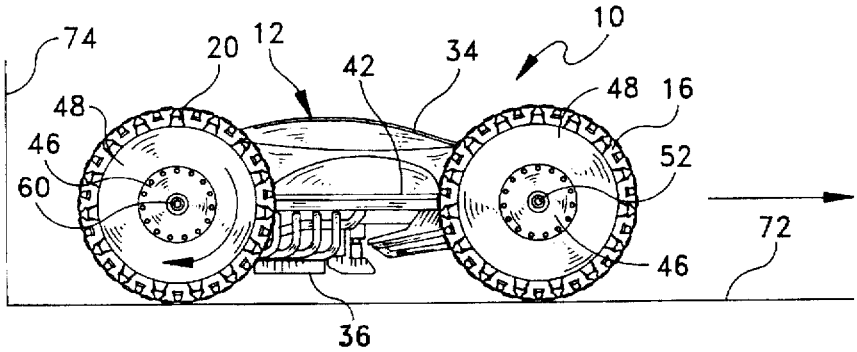
Figure 12:
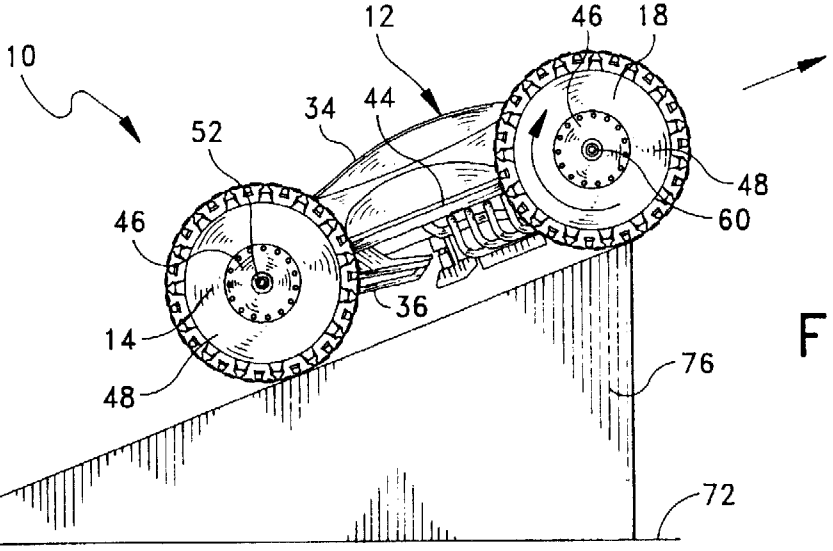
FIGS. 12 through 17 are sequential views of the vehicle during a tumbling maneuver.
Figure 13:
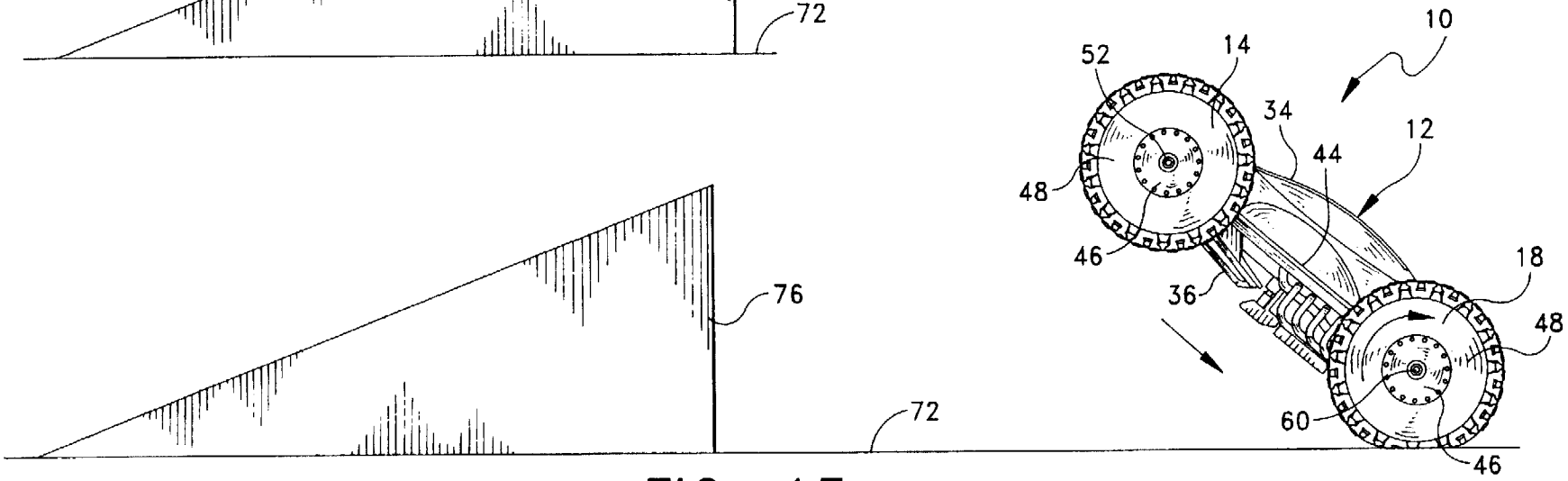
Figure 14:
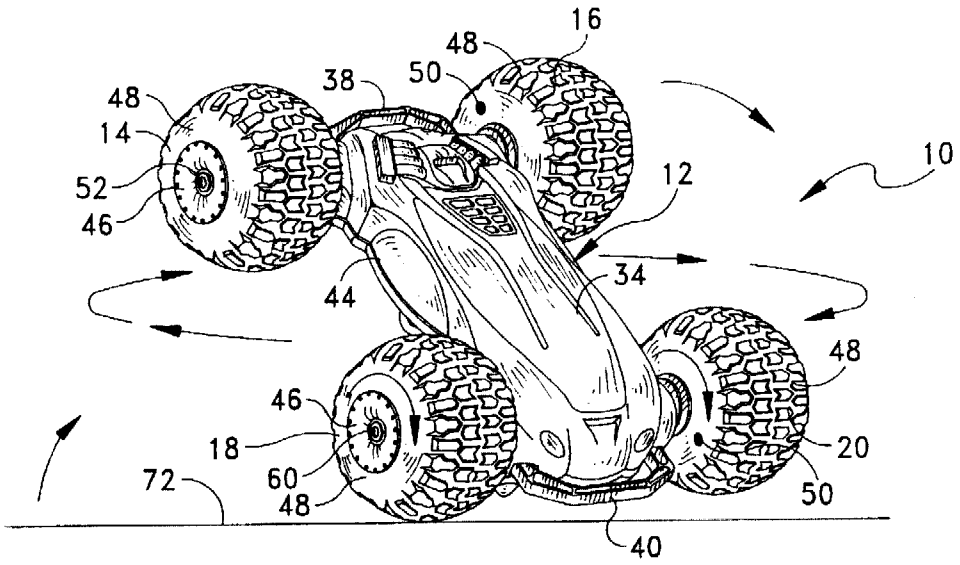
Figure 15:
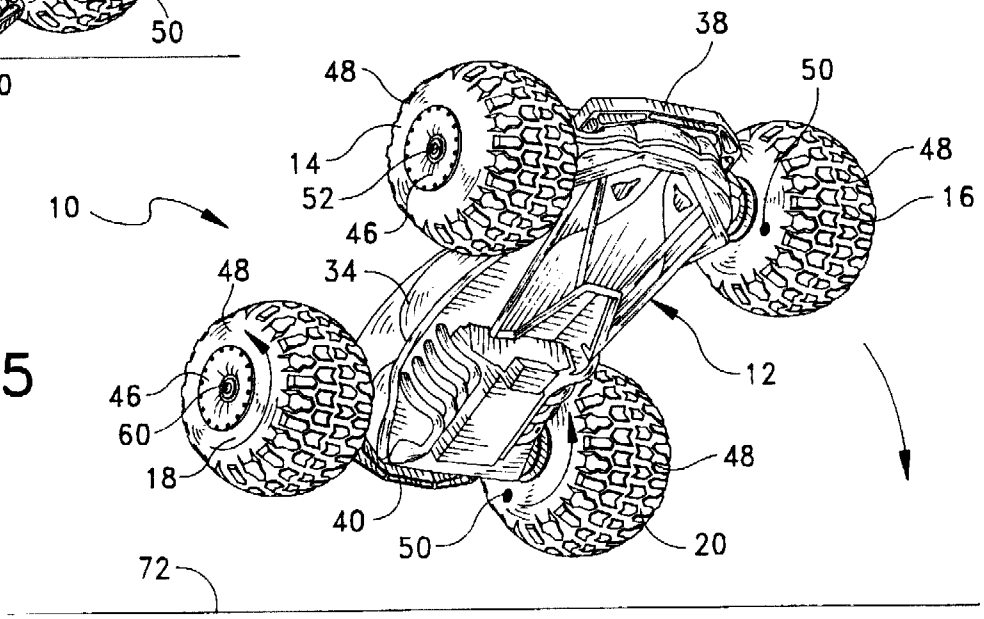
Figure 16:
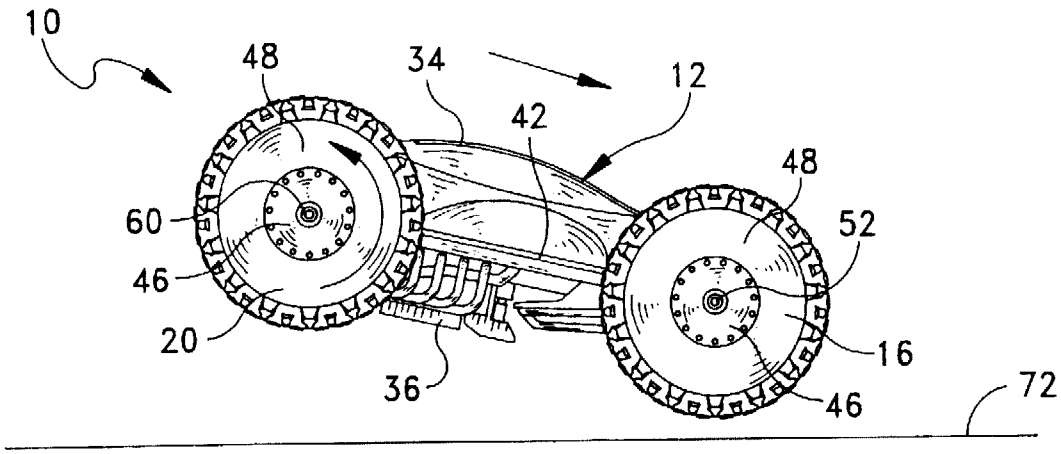

Referring now to FIGS. 5 through 11, the operation of the vehicle 10 on a substantially flat horizontal supporting surface 72 as it encounters a substantially vertical abutment surface or wall 74 is illustrated. As will be seen in FIG. 6, when the vehicle 10 encounters the wall 74, the wheels 14 and 16 are compressed against the wall 74 due to the momentum of the vehicle 10. This causes the vehicle 10 to be bounced backwardly and upwardly slightly as illustrated in FIG. 7. If the operation of the vehicle 10 is then continued such that the wheels 14 and 16 are brought back into engagement with the wall 74 before falling back to the supporting surface 72, and the drive motors 22 and 24 are operated to drive the vehicle 10 toward the wall 74, the slight upward angle of the vehicle chassis 12 and the torque of the motors 22 and 24 is normally sufficient to cause the wheels 14 and 16 to track upwardly along the wall 74 in the manner illustrated in FIG. 9. Finally, however, when the vehicle 10 reaches a substantially vertical disposition, it will fall back on itself in the manner illustrated in FIG. 10, and finally, as illustrated in FIG. 11, it will fall back onto the supporting surface 72 so that it can be operated in an inverted disposition in an opposite direction away from the wall 74.

It has been found that the overall high torque of the motors 22 and 24 is generally capable of inverting the vehicle 10 in the manner illustrated in FIGS. 5 through 11. Specifically, it has been found that if the plane of the chassis 12, as defined by the rotational axes 52 and 60, is at upwardly inclined angle extending in a direction toward the wall 74 of twenty degrees, the vehicle 10 can be effectively inverted in the manner illustrated. It has been further found that preferably the vehicle 10 is constructed so that the motors 22 and 24 have sufficient torque to invert the vehicle 10 when the plane of the chassis as defined by the axes 52 and 60 is at an angle of approximately ten degrees, and even more preferably at an angle of approximately seven degrees. It has been further found that in order to enable the vehicle 10 to effectively invert itself in this manner, regardless of whether it is in the first position illustrated in FIG. 1 or the second position illustrated in FIG. 2, the motors 22 and 24, respectively, and the battery 26 are preferably positioned between the axes 52 and 60 so that their weights are substantially uniformly distributed on opposite sides of the central plane of the chassis 12.

Figure 17:
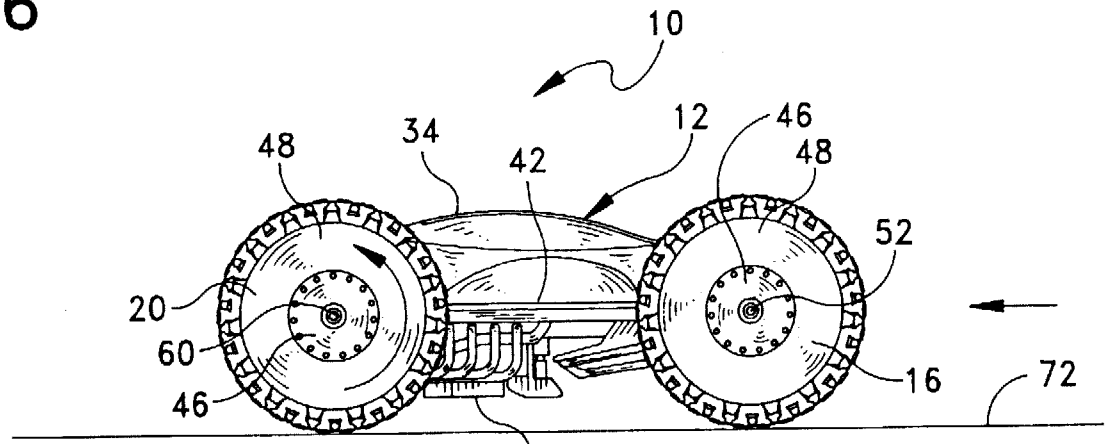
Figure 18:
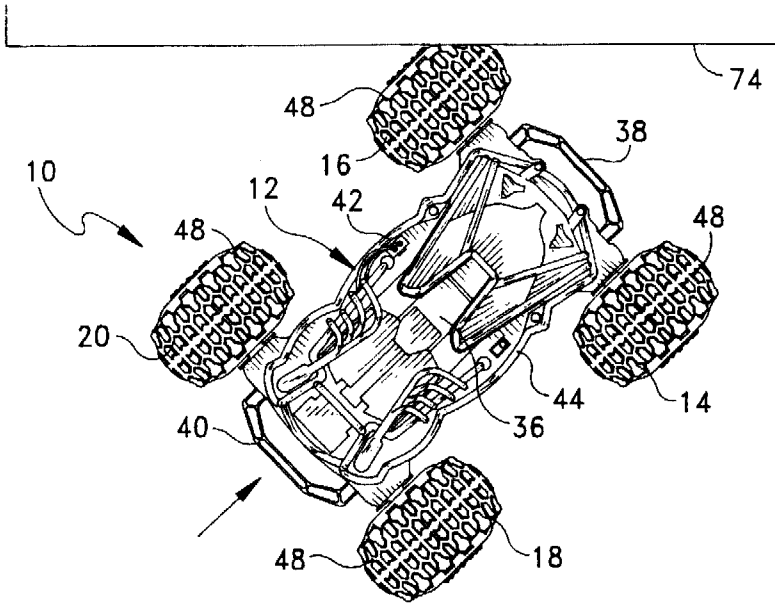
FIGS. 18 through 21 are sequential top plan views of the vehicle during a ricochet maneuver in which it is deflected off a vertical surface.
Figure 19:
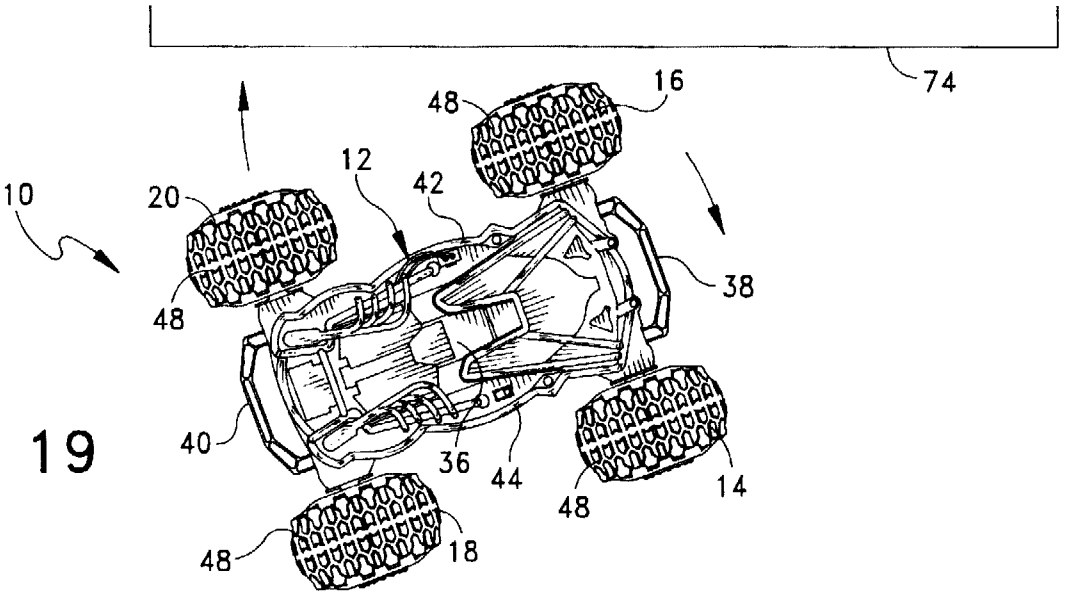

Referring now to FIGS. 12 through 17, the operation of the vehicle 10 for performing a tumbling maneuver as it is driven off a ramp 76 is illustrated. As will be seen, when the vehicle 10 is driven off the ramp 76, the second end 40 of the chassis dips downwardly until the wheels 18 and 20 contact the supporting surface 72. Because of the high resiliency of the wheels 18 and 20, the vehicle 10 then begins to tumble on the surface 72. In the stunt illustrated in FIGS. 12 through 17, the resiliency of the wheels 14, 16, 18 and 20 causes the vehicle 10 to tumble end-over-end and to also rotate side-over-side in a sequential series of steps until the vehicle 10 has been rotated 360° end-over-end and at the same time rotated 180° side-over-side. Accordingly, as illustrated in FIG. 17, the vehicle finally lands in an inverted disposition in which it is traveling in an opposite direction, despite the fact that the motors 22 and 24 continue to be operated in the same initial rotational direction. In any event, because of the configuration of the outer perimeter 30, only the support wheels 14, 16, 18 and 20 contact the supporting surface 72. Further, because the wheels 14, 16, 18 and 20 are mounted on the chassis 12 in substantially unsprung relation, the vehicle 10 tumbles as a result of the full resiliency of the tires 48 to achieve a highly dynamic tumbling effect.

Figure 20:
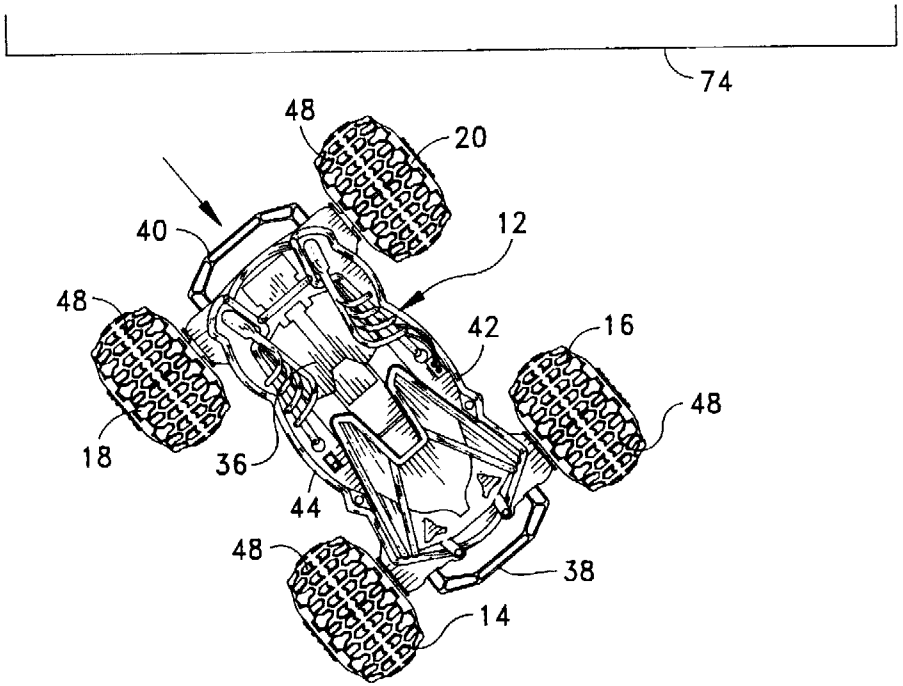
Figure 21:
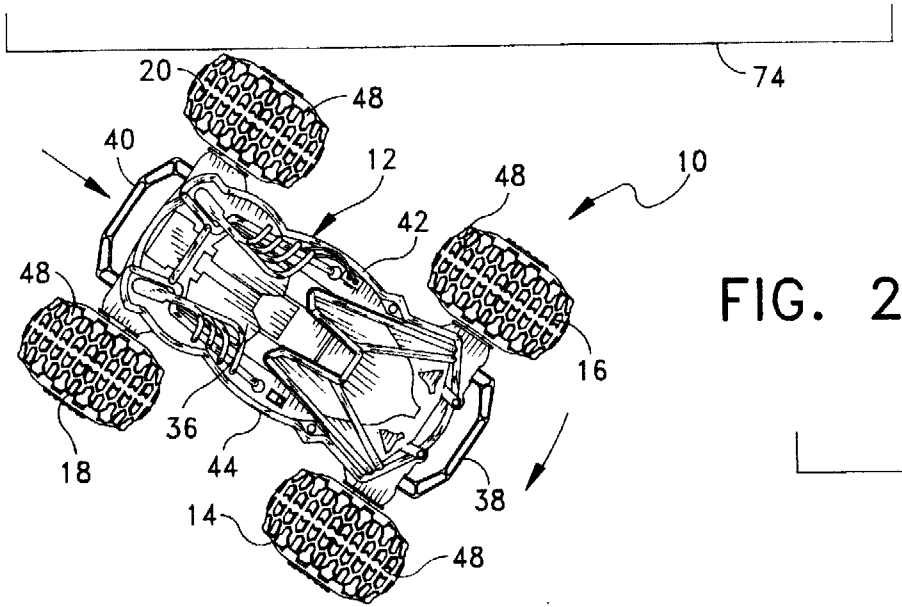

Considering next FIGS. 18 through 21, a deflection maneuver as the vehicle 10 engages the vertical abutment surface 74 at an angle is illustrated. As will be seen in FIG. 18, when the vehicle 10 initially contacts the surface 74, the wheel 16 is compressed against the surface 74, and this causes the forward portion of the vehicle 10 to be bounced angularly outwardly from the surface 74. At the same time, however, the momentum of the rear portion of the vehicle 10 causes the rear end portion of the vehicle 10 to continue to move toward the surface 74 until the resilient bouncing effect of the engagement of the wheel 16 with the surface 74 and the momentum of the rear portion of the vehicle 10 have redirected the vehicle 10 away from the wall 74 as illustrated in FIG. 20 and finally in FIG. 21.

It is seen, therefore, that the instant invention provides an effective remote control toy vehicle which is capable of performing exciting and dynamic stunts which were not possible with the heretofore available toy vehicles. In this regard, the combined effects of the high torque motors 22 and 24, the highly resilient support wheels 14, 16, 18 and 20, and the overall positions of the support wheels 14, 16, 18 and 20 enable the vehicle 10 to perform a wide variety of maneuvers, including tumbling and self-inverting maneuvers. Further, because the antenna 70 is contained entirely within the vehicle body, it is protected against damage during tumbling maneuvers. Accordingly, it is seen that the toy vehicle 10 represents a significant advancement in the toy art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A four-wheeled toy vehicle, comprising:

a chassis having a first vehicle upper body portion mounted on a first side of said chassis and a second vehicle upper body portion mounted on a second side of said chassis opposite said first side of said chassis, said chassis having a first end, a second end and a maximum height;

four rotatable axle portions mounted relative to said chassis, a first two of said axle portions being aligned with a first rotation axis and a second two of said axle portions being aligned with a second rotation axis, said axle portions being substantially unsprung relative to said chassis so that physical shocks may be delivered between said axle portions and said chassis;

four wheels rotatably mounted relative to said chassis, each of said wheels being mounted on a respective one of said axle portions, each of said wheels comprising a central hub and an elastomeric tire having an interior portion filled with air, each of said tires being resilient so that said tires can be elastically compressed against an obstacle, each of said tires being of substantially the same diameter, said diameter being greater than said maximum height of said chassis, said four tires defining a maximum three-dimensional outer perimeter which is spaced outwardly from said chassis such that no portion of said chassis extends outside of said outer perimeter;

a battery power source mounted on said chassis between a first vertical plane encompassing said first rotation axis and a second vertical plane encompassing said second rotation axis;

a first motor mounted on said chassis between said first and second vertical planes, said first motor receiving power from said battery power source and being adapted to drive one of said wheels;

a second motor mounted on said chassis between said first and second vertical planes, said second motor receiving power from said battery power source and being adapted to drive another of said wheels, said first and second motors being independently and reversibly controllable, said battery power source and said motors being mounted to said chassis so that the weight of said battery power source and said motors is uniformly distributed on opposite sides of a central plane of said chassis defined by said first and second rotation axes, said first and second motors having sufficient torque to pivot said first end of said chassis upwardly when two of said tires are in engagement with a vertical abutment surface and when said central plane of said chassis is at an upwardly inclined angle of approximately twenty degrees relative to horizontal in a direction extending from said second end of said chassis toward said first end of said chassis so that said toy vehicle may be automatically changed from a first operating position in which said first vehicle upper body portion faces upward when said toy vehicle is being driven across a horizontal surface and a second operating position in which said second vehicle upper body portion chassis faces upward when said toy vehicle is being driven across said horizontal surface;

a remote control receiver mounted on said chassis for receiving remote radio control signals for controlling said first and second motors; and an antenna operatively coupled to said remote control receiver, said antenna being located exclusively within said outer perimeter defined by said four tires.

2. A toy vehicle as defined in claim 1 wherein said first vehicle upper body portion has a different appearance than said second vehicle upper body portion.

* * * * *

UNITED STATES PATENT AND TRADEMARK OFFICE

CERTIFICATE OF CORRECTION

PATENT NO. : 5,727,985
DATED : March 17, 1998
INVENTOR(S) : George, et. al.

It is certified that error appears in the above-identified patent and that said Letters Patent is hereby corrected as shown below:

Column 5, line 9: "the w" should be --the wheels 14, 16, 18 and 20 make initial--

Column 5, line 16: "deformed" should be --defined--

Signed and Sealed this

Fifteenth Day of December, 1998

Bruce Lehman

*Attest:*

BRUCE LEHMAN

*Attesting Officer*

*Commissioner of Patents and Trademarks*